US008106554B2

(12) United States Patent
Lee et al.

(10) Patent No.: US 8,106,554 B2
(45) Date of Patent: Jan. 31, 2012

(54) BLOWER MOTOR ASSEMBLY FOR VEHICLE

(75) Inventors: Kwang Yong Lee, Daegu (KR); Dong Han Kim, Daegu (KR)

(73) Assignee: Korea Delphi Automotive Systems Corporation, Daegu (KR)

( * ) Notice: Subject to any disclaimer, the term of this patent is extended or adjusted under 35 U.S.C. 154(b) by 607 days.

(21) Appl. No.: 12/255,848

(22) Filed: Oct. 22, 2008

(65) Prior Publication Data

US 2009/0102297 A1 Apr. 23, 2009

(30) Foreign Application Priority Data

Oct. 22, 2007 (KR) ..... 10-2007-0106328
Oct. 22, 2007 (KR) ..... 10-2007-0106330

(51) Int. Cl.
*H02K 15/14* (2006.01)
*B60H 1/00* (2006.01)

(52) U.S. Cl. ..... 310/89; 310/154.03; 310/154.08; 310/154.12; 310/154.17; 310/91; 310/216.125

(58) Field of Classification Search ..... 310/89, 310/91, 154.03, 154.04, 154.05, 154.08, 310/154.12, 154.17, 216.125
See application file for complete search history.

(56) References Cited

U.S. PATENT DOCUMENTS 5,786,647 A * 7/1998 Vollmer et al. ..... 310/89
7,227,287 B2 * 6/2007 Noda et al. ..... 310/68 R
2009/0102297 A1 * 4/2009 Lee et al. ..... 310/42

FOREIGN PATENT DOCUMENTS

KR 10-2001-0111518 12/2001

* cited by examiner

*Primary Examiner* — Quyen Leung
*Assistant Examiner* — David W. Scheuermann
(74) *Attorney, Agent, or Firm* — H.C. Park & Associates, PLC

(57) ABSTRACT

Disclosed herein is a blower motor assembly for a vehicle. The blower motor assembly comprises an armature assembly, a motor body, a magnet, an upper case, and a lower case. The armature assembly comprises a rotatable armature shaft with an armature. The motor body is an open cylinder that houses the armature assembly. The magnet is installed between the motor body and the armature assembly. The upper case has a through-hole which permits the armature shaft to projects outward through. The lower case is coupled to the upper case. The motor body is installed in an internal space defined by the coupled upper and lower cases. The motor body is fixed in a correspondingly-shaped hollow portion defined by a wall of a motor body fixing portion formed in the lower case. The magnet is fixed to a magnet fixing portion formed in the lower case.

9 Claims, 7 Drawing Sheets

BLOWER MOTOR ASSEMBLY FOR VEHICLE

CROSS REFERENCE TO RELATED APPLICATIONS

This application claims priority to and the benefit of Korean Patent Application No. 10-2007-0106328, filed on Oct. 22, 2007, and Korean Patent Application No. 10-2007-0106330, filed on Oct. 22, 2007, which are both incorporated by reference for all purposes as if fully set forth herein.

BACKGROUND OF THE INVENTION

1. Field of the Invention

The present invention relates to a blower motor assembly for a blower motor assembly for a vehicle, and more particularly, to a blower motor assembly for a vehicle, including an armature assembly including a rotatable armature shaft provided with an armature that electromagnetically interacts with a stator when a current is applied, a motor body of a cylindrical shape open at a top and a bottom, for including the armature assembly therein with a predetermined gap therebetween, a magnet installed between the motor body and the armature assembly, an upper case having a through-hole which permits the armature shaft to project outward through, and a lower case coupled to the upper case, wherein the motor body is installed in an internal space defined by coupling the upper case and the lower case, and the motor body is fixed in a hollow portion of a shape corresponding to an external shape of the motor body, said hollow portion is defined by a wall of a motor body fixing portion formed on the lower case, and more preferably, the magnet is fixed to a magnet fixing portion formed in the lower case.

2. Description of the Related Art

In general, an air conditioning device for a vehicle is used to maintain a fresh interior environment by preventing the vehicle's cabin from becoming contaminated through driver/passenger respiration, and/or used to maintain a comfortable environment inside the vehicle by keeping the cabin at a comfortable temperature for occupants when the outside temperature is uncomfortably high or low.

Such air conditioning devices can be categorized into heaters used for raising cabin temperature when the outside temperature is low (such as in winter), and air coolers (commonly referred to as air conditioners) that lower cabin temperature when the outside temperature is high (such as in summer).

A heater raises the temperature inside a vehicle's cabin by using a blower to force air suctioned from the indoor/outdoor atmosphere past a heater core to raise the temperature of the air, and introduce the heated air into the cabin. An air conditioner lowers the temperature inside a vehicle's cabin by moving air suctioned from the indoor/outdoor atmosphere past an evaporator to lower the temperature of the air, and introduce the cooled air into the cabin.

FIG. 1 is a perspective view of a conventional blower for a vehicle, and FIG. 2 is a diagram of a blower motor assembly according to the prior art.

Referring to FIG. 1, a blower for a vehicle is configured with a blower housing 10 defining an air passage with an outlet and an inlet, a blower motor 20 installed within the housing 10, and a blower fan 12 installed atop the blower motor 20 to be capable of rotating within the housing 10.

FIG. 2 shows the structure of a blower motor assembly according to the prior art, and the blower motor 20 in this prior art blower motor assembly includes an armature assembly (not shown) configured with an armature shaft (not shown) rotatably installed with a bearing member (not shown) coupled thereto, and an armature (not shown) wound around the outer periphery of the armature shaft; and a magnet (not shown) attached to the inside of a motor body (not shown) of the blower motor 20 to be separated by a predetermined gap with the armature. The motor body is installed to the inside of the motor cover 50.

However, such a blower motor assembly according to the prior art is configured with a complete blower motor that is inserted and assembled within an upper and lower case, which is then installed in a vehicle's air conditioning system, and because the armature assembly is thus covered with the motor cover of the blower motor and enclosed by the overlapped upper and lower cases, the problems of increases in product weight, manufacturing cost, and number of production processes are all inherent.

Additionally, in a blower motor assembly according to the prior art, because an adhesive is used to adhere the magnets to the motor body, after which the blower motor is assembled, a process is required for drying the adhesive used to adhere the magnets to the motor body. A drying process requires approximately 24 hours, and when a drying chamber is employed for expedited drying, a temperature of approximately 170° C. to approximately 220° C. is applied for a duration of 25 to 30 minutes. Accordingly, in the prior art that requires a separate assembly process to adhere the magnets to the motor body during the blower motor assembly process, both the manufacturing cost and manufacturing time of blower motors increase, thereby involving the drawback of reduced overall productivity.

SUMMARY OF THE INVENTION

Accordingly, the present invention has been made keeping in mind the above problems occurring in the prior art, and an object of the present invention is to provide a blower motor assembly for a vehicle, comprising an armature assembly including a rotatable armature shaft provided with an armature that electromagnetically interacts with a stator when a current is applied, a motor body of a cylindrical shape open at a top and a bottom, for including the armature assembly therein with a predetermined gap therebetween, a magnet installed between the motor body and the armature assembly, an upper case having a through-hole which permits the armature shaft to project outward through, and a lower case coupled to the upper case, wherein the motor body is installed in an internal space defined by coupling the upper case and the lower case, and the motor body is fixed in a hollow portion of a shape corresponding to an external shape of the motor body, said hollow portion is defined by a wall of a motor body fixing portion formed on the lower case, and more preferably, the magnet is fixed to a magnet fixing portion formed in the lower case, and because a motor cover is not additionally required to enclose a motor body, the number of parts can be reduced, and because a additional assembly process for adhering a magnet to the motor body using an adhesive, etc. can be eliminated, the manufacturing cost of the blower motor assembly can be reduced and its assembly procedure can be simplified.

In order to accomplish the above object, the present invention provides a blower motor assembly for a vehicle, comprising: an armature assembly including a rotatable armature shaft provided with an armature that electromagnetically interacts with a stator when a current is applied; a motor body of a cylindrical shape open at a top and a bottom, for including the armature assembly therein with a predetermined gap therebetween; a magnet installed between the motor body and the armature assembly; an upper case having a through-hole which permits the armature shaft to project outward through;

and a lower case coupled to the upper case, wherein the motor body is installed in an internal space defined by coupling the upper case and the lower case, and the motor body is fixed in a hollow portion of a shape corresponding to an external shape of the motor body, said hollow portion is defined by a wall of a motor body fixing portion formed in the lower case.

Also, the wall of the motor body fixing portion is formed as a hollow cylindrical rib having a uniform thickness along a radial direction from a center of the hollow portion, and an annular compartment is formed along an outer periphery of the rib.

An outer surface of the motor body may be pressed against the wall of the motor body fixing portion formed in the lower case, and an outer surface of the magnet may be pressed and supported against an inner periphery of the motor body.

The armature shaft may comprise an upper bearing member and a lower bearing member provided at an upper portion and a lower portion, respectively, with respect to the armature.

The upper case may be provided with an upper bearing member mounting recess centered around the through-hole for mounting the upper bearing member therein, and the lower case may be provided with a lower bearing member mounting recess recessed in a concave stepped manner to be concentric with the motor body fixing portion for mounting the lower bearing member therein.

Also, the upper case and the lower case may be fastened through bolt coupling.

In order to accomplish the above object, the present invention also provides a blower motor assembly for a vehicle, comprising: an armature assembly including a rotatable armature shaft provided with an armature that electromagnetically interacts with a stator when a current is applied; a motor body of a cylindrical shape open at a top and a bottom, for including the armature assembly therein with a predetermined gap therebetween; a magnet installed between the motor body and the armature assembly; an upper case having a through-hole which permits the armature shaft to project outward through; and a lower case coupled to the upper case, wherein the motor body is installed in an internal space defined by coupling the upper case and the lower case, the motor body is fixed in a hollow portion of a shape corresponding to an external shape of the motor body, said hollow portion is defined by a wall of a motor body fixing portion formed on the lower case, and the magnet is fixed to a magnet fixing portion formed in the lower case.

The magnet fixing portion formed on the lower case may be separated apart from a wall of the motor body fixing portion by a gap corresponding to a thickness of the cylindrical motor body and projected upward, and may be formed of a curved plate extending a predetermined distance along a peripheral direction of the motor body fixing portion.

Also, the wall of the motor body fixing portion is formed as a hollow cylindrical rib having a uniform thickness along a radial direction from a center of the hollow portion, and an annular compartment is formed along an outer periphery of the rib.

An outer surface of the motor body may be pressed against the wall of the motor body fixing portion formed in the lower case, a lower surface of the motor body may be fixed to the gap formed between the motor body fixing portion and the magnet fixing portion, an outer surface of the magnet may be pressed against an inner periphery of the motor body, and each of both circumferential ends of the magnet may be pressed and fixed against either of both circumferential ends of the magnet fixing portion, respectively.

Here, the circumferential ends of the magnet fixing portion may be formed such that an angle of circumference of an inner surface thereof closer to a center of the lower case is greater than an angle of circumference of an outer surface thereof, and the circumferential ends of the magnet may be formed oppositely to the circumferential ends of the magnet fixing portion.

The magnet fixing portion(s) may be provided in a same number as the magnet(s).

The armature shaft may include an upper bearing member and a lower bearing member provided at an upper portion and a lower portion, respectively, with respect to the armature.

Also, the upper case may be provided with an upper bearing member mounting recess centered around the through-hole for mounting the upper bearing member mounted therein, and the lower case may be provided with a lower bearing member mounting recess recessed in a concave stepped manner to be concentric with the motor body fixing portion for mounting the lower bearing member therein.

Further, the upper case and the lower case may be fastened through bolt coupling.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
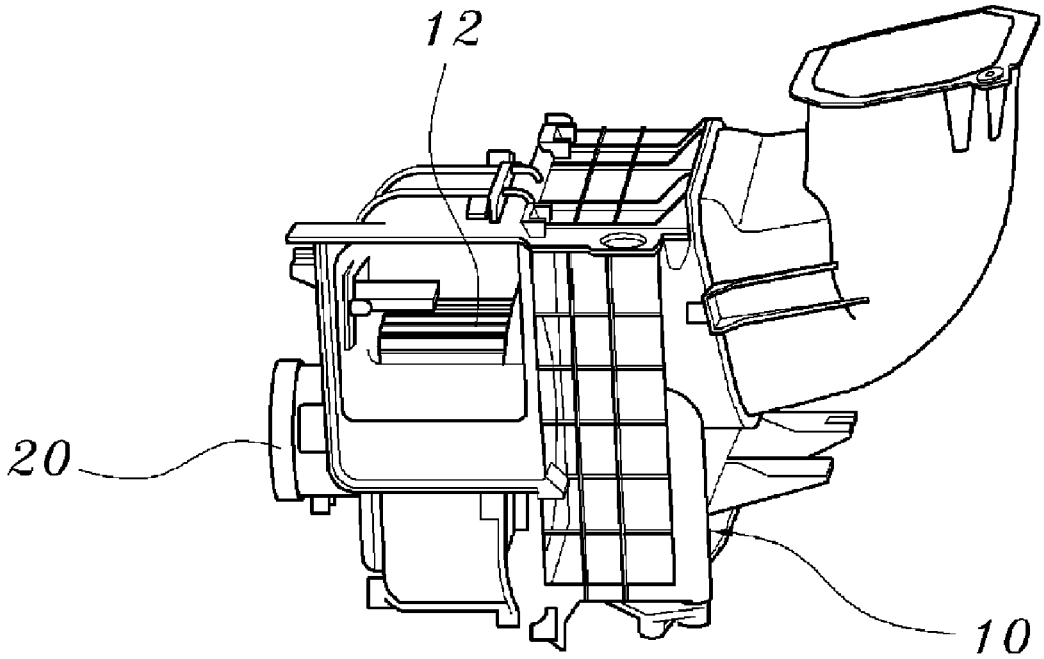
FIG. 1 Prior Art
FIG. 1 is a perspective view of a conventional blower for a vehicle.
Figure 2:
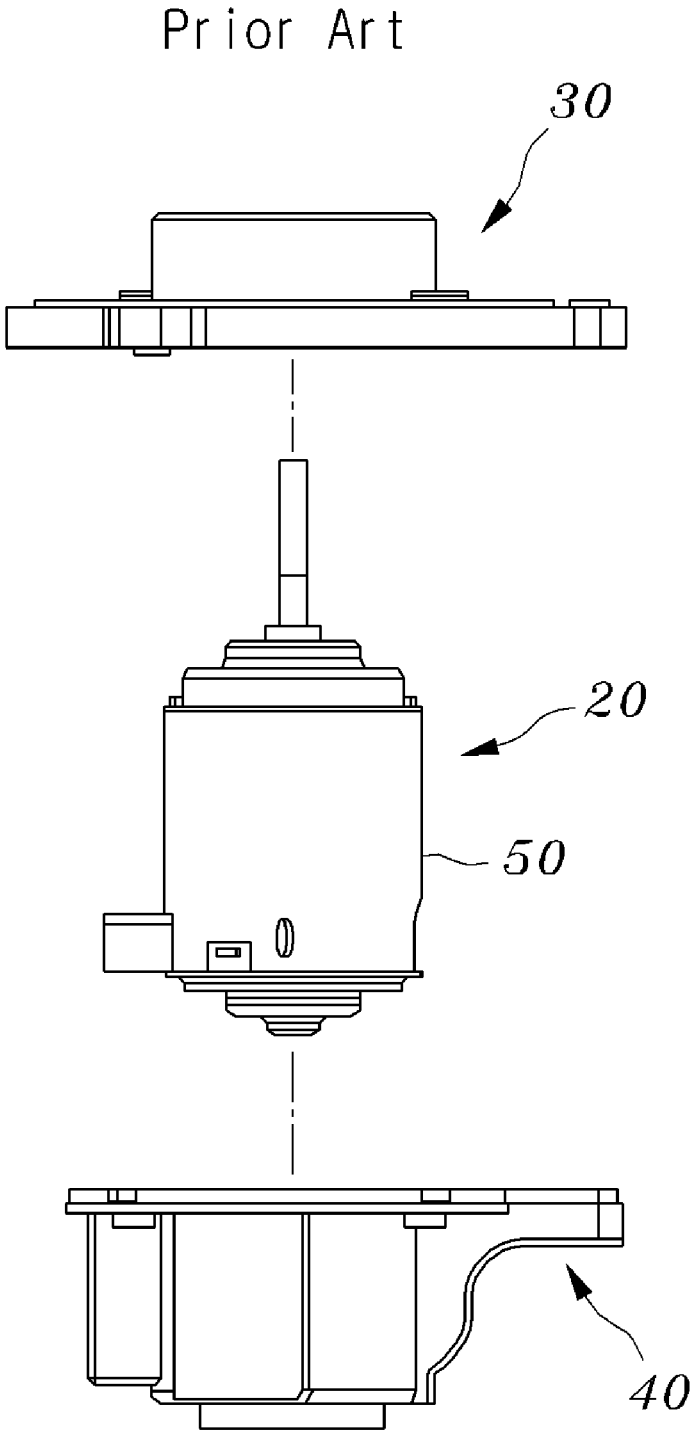
FIG. 2 is a diagram of a blower motor assembly according to the prior art.

Reference now should be made to the drawings, in which the same reference numerals are used throughout the different drawings to designate the same or similar components.

Figure 3:
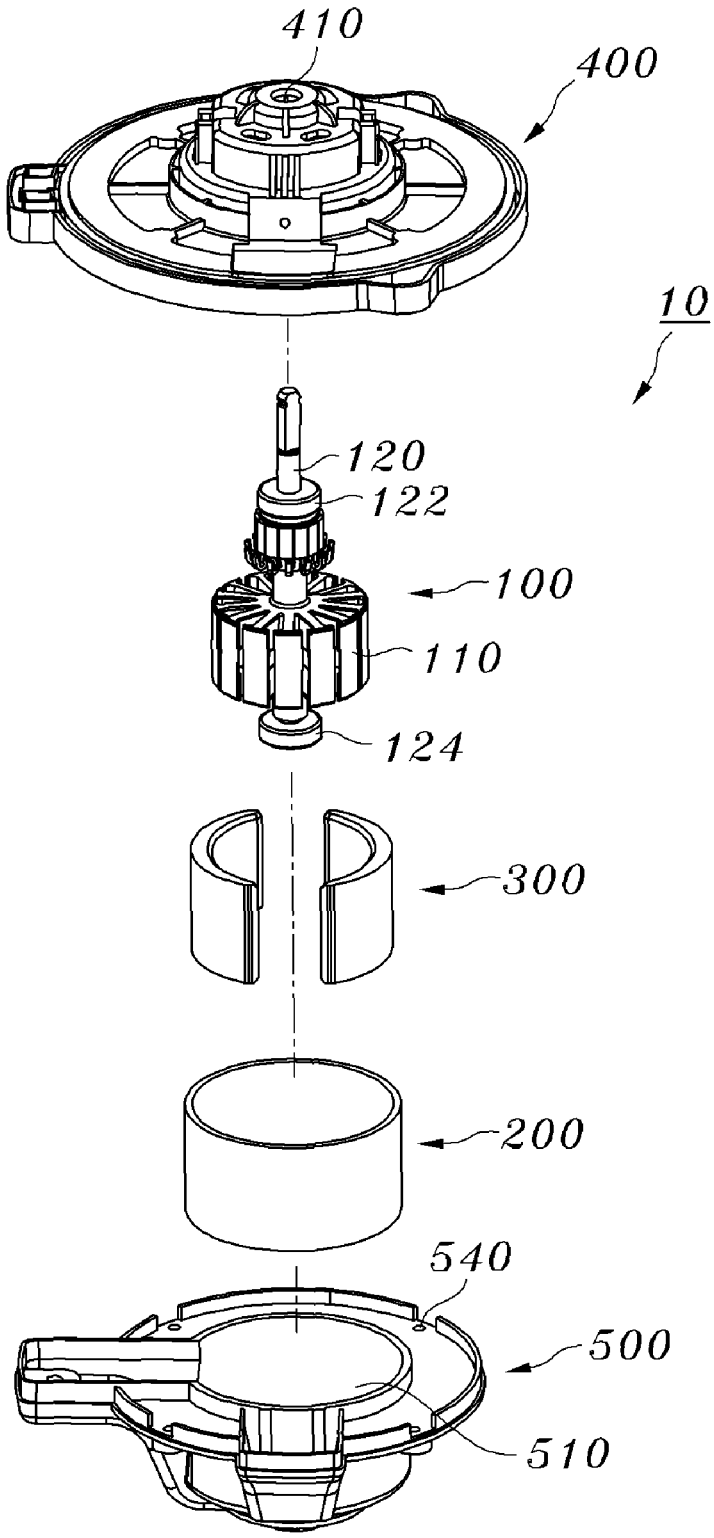
FIG. 3 is an exploded perspective view of a blower motor assembly according to the present invention.
Figure 4:
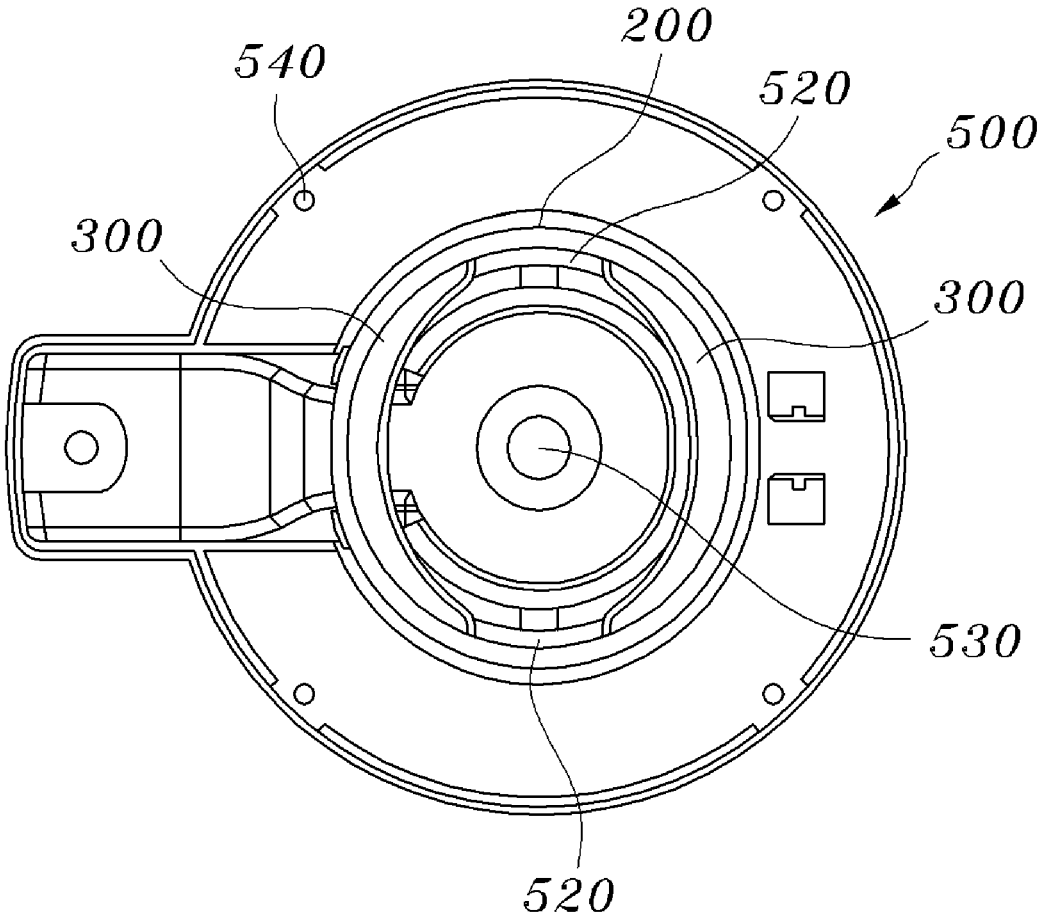
FIG. 4 is a plan view of a lower case according to an embodiment of the present invention.
Figure 5:
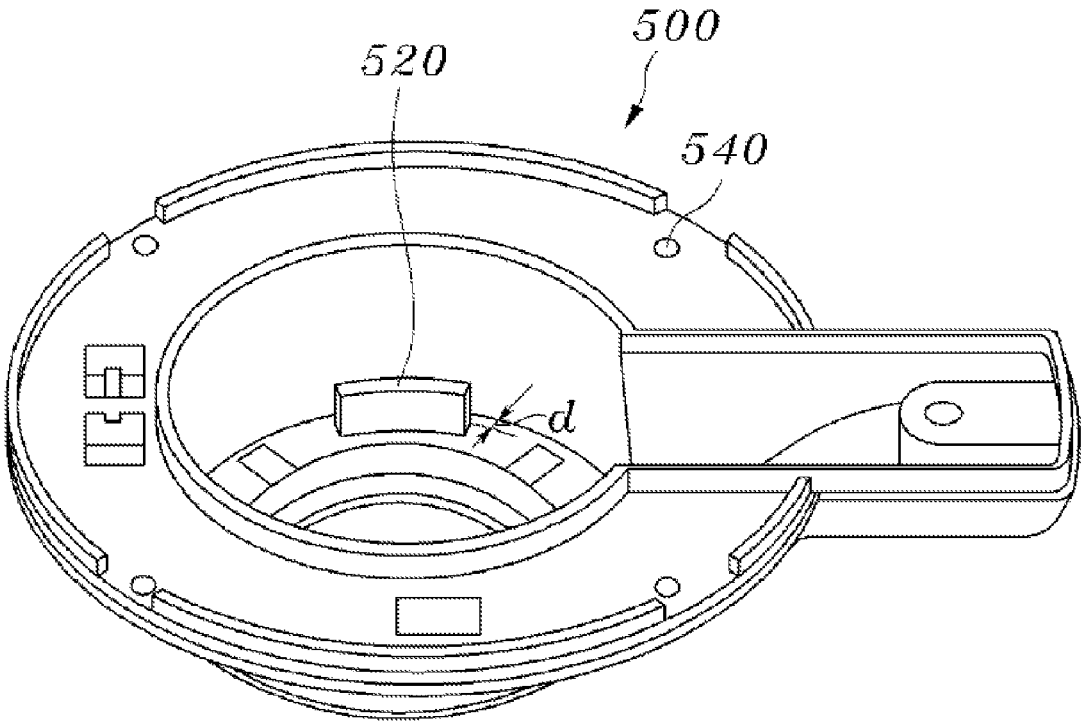
FIG. 5 is a perspective view of the lower case in FIG. 4.

Referring to FIGS. 3 through 5, a blower motor assembly 10 for a vehicle according to an embodiment of the present invention comprises an armature assembly 100 including a rotatable armature shaft 120 provided with an armature 100 that electromagnetically interacts with a magnet 300 that is a stator when a current is applied, a motor body 200 of a cylindrical shape open at a top and a bottom, for including the armature assembly 100 therein with a predetermined gap therebetween, the magnet 300 installed between the motor body 200 and the armature assembly 100, an upper case 400 having a through-hole 410 which permits the armature shaft 120 to project outward through, and a lower case 500 coupled to the upper case 400, where the motor body 200 is installed in an internal space defined by coupling the upper case 400 and the lower case 500, and the motor body 200 is fixed in a hollow portion of a shape corresponding to an external shape of the motor body 200, said hollow portion is defined by a wall of a motor body fixing portion 510 formed in the lower case 500.

In comparison to the above embodiment, a blower motor assembly 10 for a vehicle according to another embodiment of the present invention is the same in that it includes an armature assembly 100, a motor body 200, a magnet 300, an upper case 400, and a lower case 500, where the motor body 200 is installed in an internal space defined by coupling the upper case 400 and the lower case 500, and the motor body 200 is fixed to a hollow portion of a shape corresponding to an external shape of the motor body 200, said hollow portion is defined by a wall of a motor body fixing portion 510 formed on the lower case 500, and is characterized by a difference in that the magnet 300 is fixed to a magnet fixing portion 520 formed on the lower case 500.

In the blower motor assembly 10 according to the present invention, the mounting and fixing of the motor body 200 to the lower case 500, and the mounting and fixing of the motor body 200 and the magnet 300 to the lower case 500, respectively, will be described in further detail below with reference to FIGS. 4 and 5.

A motor body fixing portion 510 formed on the lower case 500 includes a wall with a curved shape that defines a hollow portion with a round sectional shape corresponding to the shape of the motor body 200. That is, the outer surface of the motor body 200 is inserted while pressed against the wall to fix the motor body 200 to the lower case 500.

Also, the magnet fixing portion 520 is separated apart from the wall of the motor body fixing portion 510 by a distance "d" (in FIG. 5) corresponding to a thickness of the cylindrical motor body 200 and projected upward, and is formed of a curved plate extending a predetermined distance along a peripheral direction of the motor body fixing portion 510. The magnet fixing portion 520 is provided in the same number as the magnet 300. Accordingly, when the magnet 300 is formed in two pieces, the magnet fixing portion 520 is also provided in duplicate. To exemplarily describe the magnet 300 as formed in two pieces, the magnet fixing portion 520 may be provided at positions facing one another about the center of the centrifugal section of the motor body fixing portion 510, and two pieces of the magnet 300 having the shapes of portions of a hollow cylinder that is cut along its length are pressed and fixed between the two magnet fixing portions 520. In other words, when all the angles of circumference of the two magnets 300 and the two magnet fixing portions 520 are added, the sum is 360°.

In particular, the respective centrifugal ends of the magnet fixing portions 520 are formed such that the angles of circumference at the inner surfaces (the surfaces closer to the center of the motor body fixing portion 510) are greater than the angles of circumference at the outer surfaces, and the respective centrifugal ends of the magnets 300 are formed oppositely. Thus, because the ends of the magnets 300 can be inserted like wedges between the magnet fixing portions 520, they are firmly fixed. Here, the heights of the magnets 300 may be made less than or the same as the height of the motor body 200. While the magnet 300 has been described above as provided in two pieces, when the magnet is cut along a portion of the circumferential length of a cylinder to form a "C" shape, for example, it will be apparent to one skilled in the art that the magnet fixing portion 520 may be provided singularly in a shape corresponding to the shapes of the magnets 300 formed along the "C" shape.

The method of fixing the motor body 200 and the magnet 300 respectively on the lower case 500 in the above two embodiments of the present invention, will be described in further detail.

First, in one embodiment of the present invention, the motor body 200 can sufficiently be fixed by inserting the outer surface of the motor body 200 through pressing against the curved surface of the motor body fixing portion 510 formed on the lower case 500, and here, the outer periphery of the magnet 300 is pressed against and supported by the inner surface of the motor body 200. Accordingly, when the magnet fixing portion 520 is not formed on the lower case 500, the motor body 200 is fixed through being pressed against the motor body fixing portion 510, and then the magnet 300 is fixed to the inner periphery of the motor body 200 by being pressed against the latter.

In addition, in the other embodiment according to the present invention, the outer surface of the motor body 200 is pressed against the curved surface of the motor body fixing portion 510 formed on the lower case 500, and finally, the lower surface of the motor body 200 is inserted in a gap formed between the motor body fixing portion 510 and the magnet fixing portion 520. Then, the outer surfaces of the two pieces of the magnet 300 are pressed against the inner periphery of the motor body 200 and inserted and fixed between the two magnet fixing portions 520. Accordingly, through the configuration of the magnet fixing portions 520, not only the magnet 300 pieces, but also the motor body 200 are firmly mounted and fixed to the lower case 500.

Resultantly, a blower motor assembly 10 configured as above according to the present invention has the motor body 200 directly fixed to the lower case 500 without including a motor cover employed in prior art blower motors for enclosing the motor body 200. Also, because the process of adhering the magnet 300 to the inner periphery of the motor body 200 using an adhesive, etc. can be deleted, the number of parts enclosing the motor body 200 can be reduced to lower manufacturing cost and simplify the overall assembly process.

The armature assembly 100 is assembled to the lower case 500, to which the motor body 200 and the magnet 300 are coupled. A lower bearing member 124 is installed below the armature 110 coupled to the armature shaft 120 of the armature assembly 100, and a lower bearing member mounting recess 530 is recessed in a concave stepped configuration into the lower surface of the lower case 500 to be concentric with the motor body fixing portion 510. Accordingly, the lower structure of the armature assembly 100 is supported through mutual coupling of the lower bearing member 124 and the lower bearing member mounting recess 530.

Figure 6:
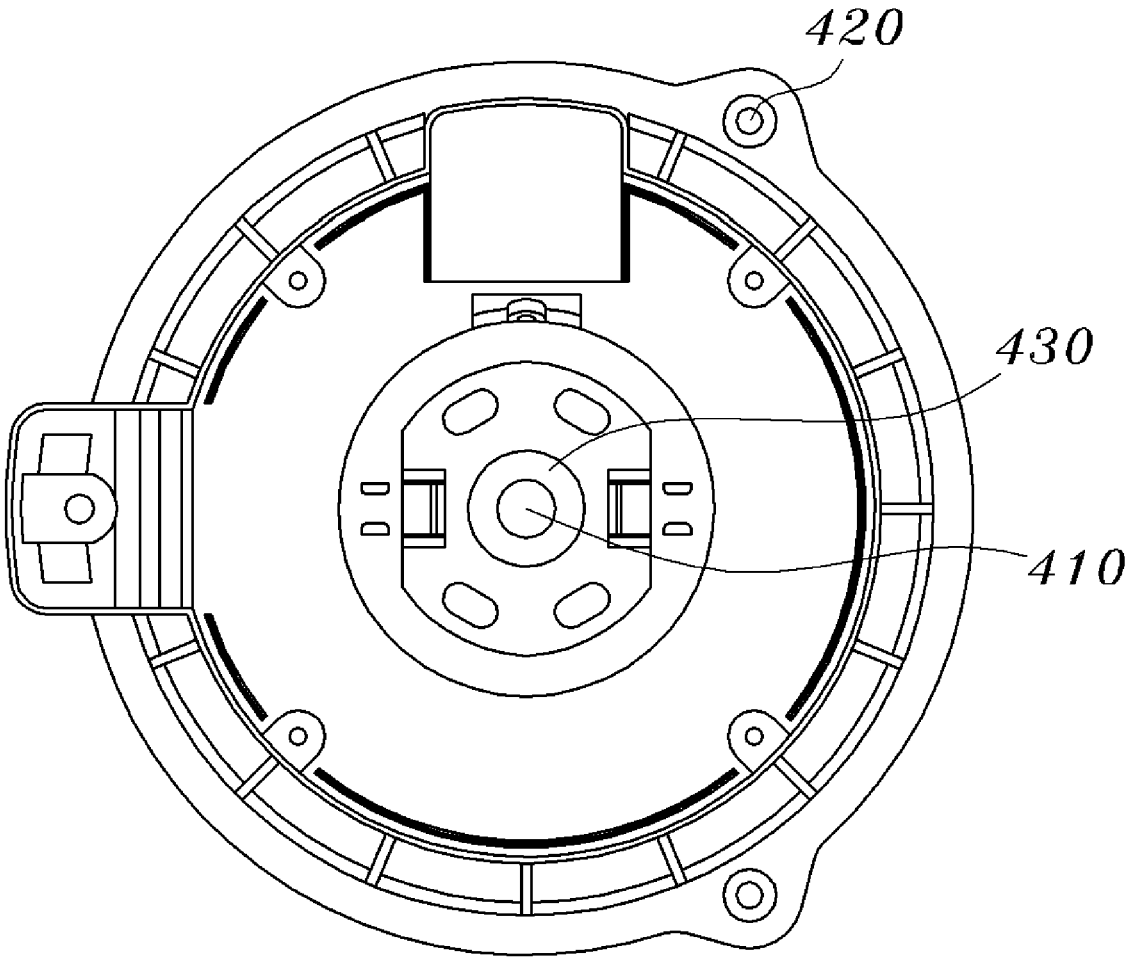
FIG. 6 is a plan view of an upper case according to an embodiment of the present invention.

Then, the lower case 500, to which the motor body 200, the magnet 300, and the armature assembly 100 are coupled, is coupled to and covered by the upper case 400 at its upper surface. Referring to FIG. 6, the upper case 400 is similar to the lower case 500 in that it has an upper bearing member mounting recess 430 centered around a through-hole 410 which permits the upper end of the armature shaft 120 to project outward, and an upper bearing member 122 is installed above the armature 110 coupled to the armature shaft 120. Accordingly, the upper structure of the armature assembly 100 is supported by mutual coupling of the upper bearing member 122 and the upper bearing member mounting recess 430. A blower fan is coupled to the end of the armature shaft 120 projecting outward from the upper case 400.

The coupling of the lower case 500 and the upper case 400 is performed with bolts respectively employing bolt holes 420 and 540 provided in the cases 400 and 500. Of course, the coupling of the upper case 400 and the lower case 500 may be performed through one of many other publically known techniques—for example, through ultrasonic bonding or using clips.

Figure 7:
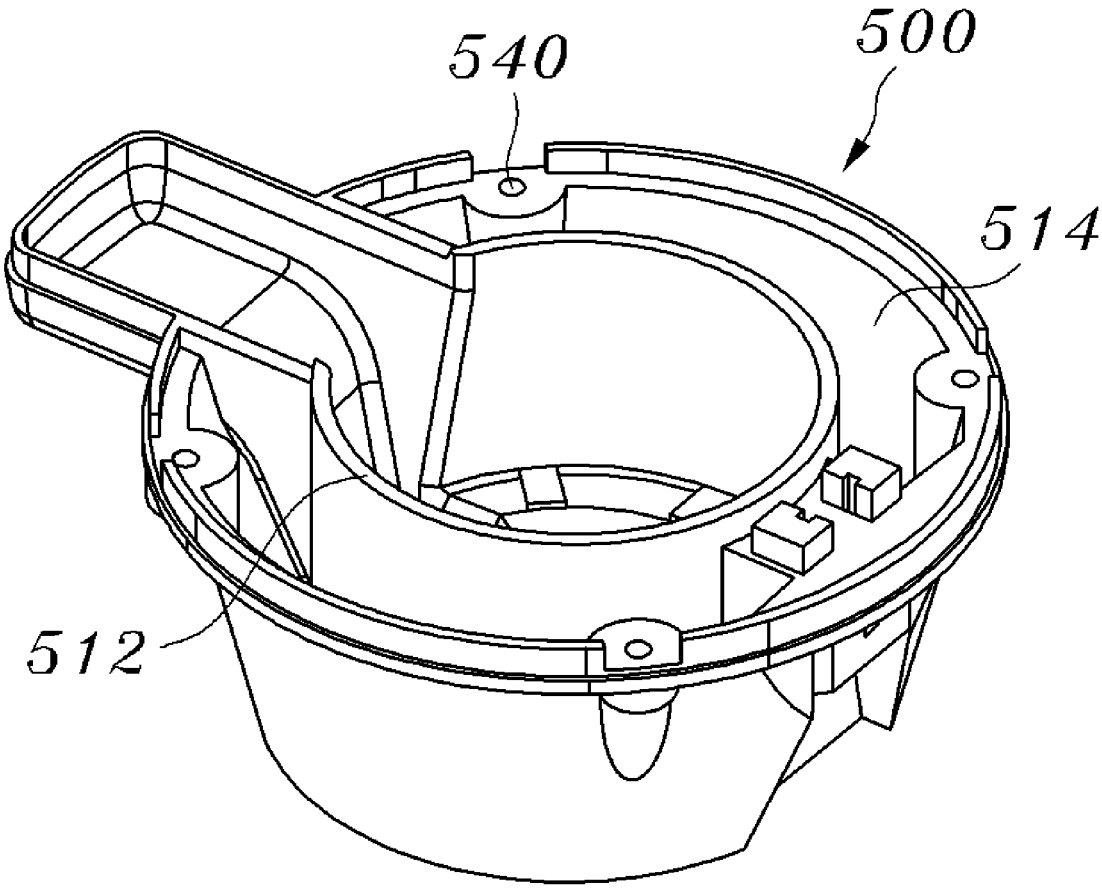
FIG. 7 is a perspective view of a lower case according to another embodiment of the present invention.

FIG. 7 illustrates another preferred embodiment of a motor body fixing portion 510 from the structure of the lower case 500 according to the present invention. According to the present embodiment, in the structure of the motor body fixing portion 510, the wall of the motor body fixing portion 510 is formed as an open cylindrical rib 512 having a uniform thickness along a radial direction about the center of the hollow portion, and an annular compartment 514 is provided along the outer periphery of the rib 512. In this configuration, transmission of vibration and noise generated from the rotation of the armature assembly 100 to the entire blower motor assembly 10 can effectively be blocked. Of course, this rib 512 and annular compartment 514 configuration may be provided for the upper case 400, not the lower case 500, and may be provided for both the upper case 400 and the lower case 500 in certain cases. Such variations are dependent upon which of the upper and lower cases 400 and 500 the motor body 200 will be supported, and because the configuration will not change, further detailed description thereof will not be provided.

In general, the upper case 400, the lower case 500, and components included therein (such as bearing member mounting recesses, a motor body fixing portion, and a magnet fixing portion) may be integrally formed through injection molding. Also, the upper case 400 and the lower case 500 may be made to accommodate a brush holder, electromagnetic interference (EMI) equipment, etc. required for operation of the blower motor.

Because the present invention does not require a motor cover to enclose a motor body, when compared to the prior art, the number of parts can be reduced, and because a additional assembly process for adhering a magnet to the motor body using an adhesive, etc. can be eliminated, the manufacturing cost of the blower motor assembly can be reduced and its assembly procedure can be simplified, so that increase in productivity can ultimately be realized.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A blower motor assembly for a vehicle, comprising:

an armature assembly including a rotatable armature shaft provided with an armature that electromagnetically interacts with a stator when a current is applied;

a motor body of a cylindrical shape open at a top and a bottom, for including the armature assembly therein with a predetermined gap therebetween;

a magnet installed between the motor body and the armature assembly;

an upper case having a through-hole which permits the armature shaft to project outward through; and a lower case coupled to the upper case, wherein the motor body is installed in an internal space defined by coupling the upper case and the lower case, the motor body is fixed in a hollow portion of a shape corresponding to an external shape of the motor body, said hollow portion is defined by a wall of a motor body fixing portion formed on the lower case, and the magnet is fixed to a magnet fixing portion formed in the lower case.

2. The blower motor assembly as claimed in claim 1, wherein the magnet fixing portion formed on the lower case is spaced apart from a wall of the motor body fixing portion by a gap corresponding to a thickness of the cylindrical motor body and projected upward, and is formed of a curved plate extending a predetermined distance along a peripheral direction of the motor body fixing portion.

3. The blower motor assembly as claimed in claim 1, wherein the wall of the motor body fixing portion is formed as a hollow cylindrical rib having a uniform thickness along a radial direction from a center of the hollow portion, and an annular compartment is formed along an outer periphery of the rib.

4. The blower motor assembly as claimed in claim 2, wherein an outer surface of the motor body is pressed against the wall of the motor body fixing portion formed in the lower case, a lower surface of the motor body is fixed to the gap formed between the motor body fixing portion and the magnet fixing portion, an outer surface of the magnet is pressed against an inner periphery of the motor body, and each of both circumferential ends of the magnet is pressed and fixed against either of both circumferential ends of the magnet fixing portion, respectively.

5. The blower motor assembly as claimed in claim 4, wherein the circumferential ends of the magnet fixing portion are formed such that an angle of circumference of an inner surface thereof closer to a center of the lower case is greater than an angle of circumference of an outer surface thereof, and the circumferential ends of the magnet are formed oppositely to the circumferential ends of the magnet fixing portion.

6. The blower motor assembly as claimed in claim 1, wherein the magnet fixing portion(s) is/are provided in a same number as the magnet(s).

7. The blower motor assembly as claimed in claim 1, wherein the armature shaft comprises an upper bearing member and a lower bearing member provided at an upper portion and a lower portion, respectively, with respect to the armature.

8. The blower motor assembly as claimed in claim 7, wherein the upper case is provided with an upper bearing member mounting recess centered around the through-hole for mounting the upper bearing member therein, and the lower case is provided with a lower bearing member mounting recess recessed in a concave stepped manner to be concentric with the motor body fixing portion for mounting the lower bearing member therein.

9. The blower motor assembly as claimed in claim 1, wherein the upper case and the lower case are fastened through bolt coupling.

* * * * *